US012532940B1

(12) United States Patent
Bligh et al.

(10) Patent No.: US 12,532,940 B1
(45) Date of Patent: Jan. 27, 2026

(54) SOLE STRUCTURE FOR A SHOE

(71) Applicant: adidas AG, Herzogenaurach (DE)

(72) Inventors: Reuben Bligh, Portland, OR (US); Tom Elvidge, Portland, OR (US); Zachary Coonrod, Seattle, WA (US); Pete Cauwood, Cambridge (GB); Iain Sabberton, Cambridge (GB); Simon Wilsher, Letchworth Garden City (GB); Peter Laitenberger, Cambridge (GB); Keir Jackson, Waltham Forest (GB)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/781,607

(22) Filed: Jul. 23, 2024

(51) Int. Cl.
*A43B 13/14* (2006.01)
*A43B 13/16* (2006.01)

(52) U.S. Cl.
CPC ..... *A43B 13/141* (2013.01); *A43B 13/16* (2013.01)

(58) Field of Classification Search
CPC ..... A43B 13/141; A43B 13/16; A43B 13/14; A43B 13/181; A43B 13/183
See application file for complete search history.

(56) References Cited

U.S. PATENT DOCUMENTS 5,337,492 A * 8/1994 Anderie ..... A43B 13/181 36/114
5,461,800 A * 10/1995 Luthi ..... A43B 13/206 36/114
6,189,239 B1 * 2/2001 Gasparovic ..... A43B 13/141 36/102
6,401,366 B2 6/2002 Foxen et al.
6,763,611 B1 * 7/2004 Fusco ..... A43B 13/181 36/27
10,750,819 B2 8/2020 Bunndell et al.
10,806,217 B2 10/2020 Bock
2010/0154258 A1 6/2010 Scholz et al.
2015/0000161 A1 * 1/2015 Peyton ..... A43B 3/246 36/103
2015/0033581 A1 * 2/2015 Barnes ..... A43B 13/188 36/83
2020/0205512 A1 * 7/2020 Blanche ..... A43B 11/00
2023/0301396 A1 * 9/2023 Blanche ..... A43B 3/246
2024/0172836 A1 * 5/2024 Langvin ..... A43B 13/141

FOREIGN PATENT DOCUMENTS

EP 1947970 B1 5/2014
EP 2742818 A1 6/2014

OTHER PUBLICATIONS

Sterzing et al., "Kicking Velocity: Barefoot Kicking Superior to Shod Kicking?," Jan. 2008; 6 pages.

* cited by examiner

*Primary Examiner* — Jameson D Collier
(74) *Attorney, Agent, or Firm* — Sterne, Kessler, Goldstein & Fox P.L.L.C.

(57) ABSTRACT

A sole structure for a shoe includes a forefoot portion and a heel portion. A midfoot portion can be coupled to the forefoot portion and the heel portion. The midfoot portion is configured to bend in a plantarflexion direction and a dorsiflexion direction. The midfoot portion includes various elements disposed at a ground-facing side of the midfoot portion that can alter bending characteristics of the midfoot portion.

17 Claims, 6 Drawing Sheets

SOLE STRUCTURE FOR A SHOE

TECHNICAL FIELD

The present disclosure relates to a sole structure for a shoe, in particular a football shoe, and a shoe comprising the sole structure.

BACKGROUND

When designing soles for shoes to be used for participation in athletic activities, the use of the foot when engaging in those activities should be considered. For example, velocity of a ball that is kicked can increase with increased plantarflexion of the foot of the kicker. Stability of the foot while the participant runs, jumps, cuts, etc., should also be considered. Hence, there is a continuing need for shoes designed to improve the overall properties of the sole structure of the shoe.

BRIEF SUMMARY

A first embodiment (I) of the present disclosure is directed to a sole structure for a shoe, comprising: a forefoot portion; a heel portion; and a midfoot portion coupled to the forefoot portion and the heel portion, the midfoot portion configured to bend in a plantarflexion direction and a dorsiflexion direction, the midfoot portion comprising: a first bending element disposed at a ground-facing side of the midfoot portion, the first bending element comprising a plurality of segments extending between the forefoot portion and the heel portion, the plurality of segments comprising a first segment and a second segment, the first bending element further comprising a first hinge extending between the first segment and the second segment, and a second bending element disposed at an upper-facing side of the midfoot portion, the second bending element vertically spaced apart from the first bending element, wherein when the midfoot portion bends in the plantarflexion direction, a ground-facing side of the first segment moves toward a ground-facing side of the second segment, and when the midfoot portion bends in the dorsiflexion direction, the ground-facing side of the first segment moves away from the ground-facing side of the second segment.

A second embodiment (II) of the present disclosure is directed to the sole structure of the first embodiment (I), further comprising a first connector coupling the first bending element and the second bending element, the first connector located between the first segment and the forefoot portion, and a second connector coupling the first bending element and the second bending element, the second connector located between the second segment and the heel portion.

A third embodiment (III) of the present disclosure is directed to the sole structure of the second embodiment (II), wherein the first bending element comprises first connection locations for coupling the first connector and the second connector to the first bending element, and the second bending element comprises second connection locations for coupling the first connector and the second connector to the first bending element.

A fourth embodiment (IV) of the present disclosure is directed to the sole structure of the third embodiment (III), wherein a number of the first connection locations is less than a number of the second connection locations.

A fifth embodiment (V) of the present disclosure is directed to the sole structure of the third embodiment (III) or the fourth embodiment (IV), wherein at least one of the first connection locations is disposed at the first hinge.

A sixth embodiment (VI) of the present disclosure is directed to the sole structure of any one of the previous embodiments, wherein the midfoot portion comprises a first bending stiffness in the plantarflexion direction and a second bending stiffness in the dorsiflexion direction that is larger than the first bending stiffness.

A seventh embodiment (VII) of the present disclosure is directed to the sole structure of any one of the previous embodiments, wherein, when the midfoot portion bends in the plantarflexion direction, the first segment and the second segment fold toward each other, and when the midfoot portion bends in the dorsiflexion direction, the first segment and the second segment fold away from each other.

An eighth embodiment (VIII) of the present disclosure is directed to the sole structure of any one of the previous embodiments, wherein the midfoot portion comprises a polymer material.

A ninth embodiment (IX) of the present disclosure is directed to the sole structure of any one of the previous embodiments, wherein the plurality of segments further comprises a third segment and a fourth segment, and the first bending element further comprises a second hinge extending between the third segment and the fourth segment.

A tenth embodiment (X) of the present disclosure is directed to the sole structure of the ninth embodiment (IX), wherein the first hinge extends approximately parallel to the second hinge in a direction transverse to a longitudinal axis of the midfoot portion.

An eleventh embodiment (XI) of the present disclosure is directed to the sole structure of either of the ninth embodiment (IX) or the tenth embodiment (X), wherein a longitudinal distance between the first hinge and the second hinge at a first side of the midfoot portion is greater than a longitudinal distance between the first hinge and the second hinge at a second side of the midfoot portion.

A twelfth embodiment (XII) of the present disclosure is directed to the sole structure of the eleventh embodiment (XI), wherein the first hinge extends at an angle relative to the second hinge in a direction transverse to a longitudinal axis of the midfoot portion, and wherein the angle between the first hinge and the second hinge is greater than or equal to 5 degrees and less than or equal to 45 degrees.

A thirteenth embodiment (XIII) of the present disclosure is directed to the sole structure of any one of the previous embodiments, wherein the first segment extends approximately parallel to the second segment in a direction transverse to a longitudinal axis of the midfoot portion.

A fourteenth embodiment (XIV) of the present disclosure is directed to the sole structure of any one of the first embodiment (I) through the twelfth embodiment (XII), wherein the first segment extends at an angle relative to the second segment in a direction transverse to a longitudinal axis of the midfoot portion, and wherein the angle between the first segment and the second segment is greater than or equal to 5 degrees and less than or equal to 45 degrees.

A fifteenth embodiment (XV) of the present disclosure is directed to the sole structure of any one of the previous embodiments, wherein the midfoot portion bridges a gap between the forefoot portion and the heel portion.

A sixteenth embodiment (XVI) of the present disclosure is directed to a shoe comprising the sole structure of any one of the previous embodiments.

A seventeenth embodiment (XVII) of the present disclosure is directed to the shoe of the sixteenth embodiment (XVI), wherein each of the forefoot portion and the heel portion comprise cleats.

BRIEF DESCRIPTION OF THE DRAWINGS/FIGURES

DETAILED DESCRIPTION

Figure 1:
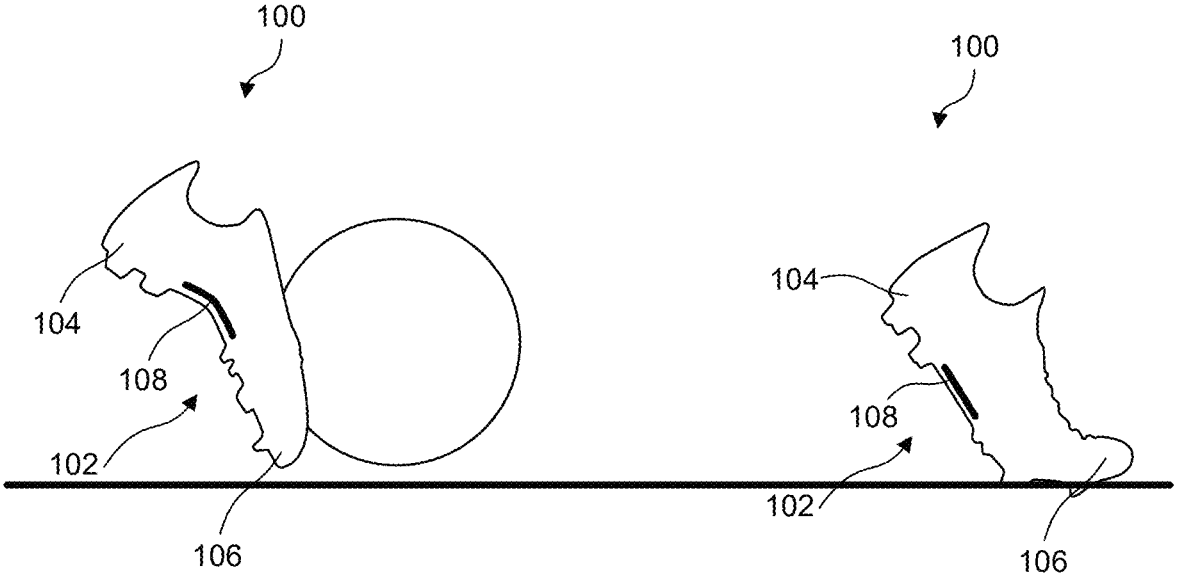
FIG. 1 shows a position of a midfoot portion of a shoe during a kicking motion and a running motion.

The indefinite articles "a," "an," and "the" include plural referents unless clearly contradicted or the context clearly dictates otherwise.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

As used herein, unless specified otherwise, reference to objects or axes being "approximately parallel" to each other includes parallel and relationships between the objects or axes up to and including within ten degrees of being parallel. For example, two axes that are oriented at an angle of negative 10 degrees to positive 10 degrees relative to each other are considered approximately parallel.

As used herein, unless specified otherwise, reference to objects or axes being "approximately perpendicular" to each other includes perpendicular and relationships between the objects or axes up to and including within 10 degrees of being perpendicular. For example, two axes that are oriented at an angle of 80-100 degrees relative to each other are considered approximately perpendicular.

As used herein, unless specified otherwise, reference to an object or axis being "approximately orthogonal" to other objects or axes includes orthogonal and relationships between the objects or axes up to and including within 10 degrees of being orthogonal. For example, a first axis can be considered orthogonal to a second axis and a third axis if the first axis is oriented at an angle of 80-100 degrees relative to each of the second axis and the third axis.

As used herein, unless specified otherwise, reference to a value being "approximately constant" refers to instances in which the value is constant or within a range up to and including plus or minus 10 percent of the stated value. For example, a stated length L is considered approximately constant for values of 0.9 L-1.1 L.

As used herein, unless specified otherwise, reference to two or more values being "approximately equal" refers to instances in which the two or more values are equal or within 10 percent of being equal. For example, values of 9 and 11 are considered approximately equal to a stated value of 10.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

Sole structures according to embodiments of the present application are designed to provide various advantageous effects for a wearer. The sole structures can facilitate optimal athletic performance for a wearer participating in a sport, for example football, while also providing footwear that is supportive. The sole structures are designed to provide flexibility in particular directions and stiffness in other directions. The combination of flexibility and stiffness can facilitate desired athletic performance characteristics while also providing support for the feet of the wearer. Sole structures according to embodiments of the present application are designed to address and/or pursue the following problems and/or objectives at least partially.

Sole structures for shoes (for example, football shoes) that are optimized for running can exhibit a stiff flexural behaviour. This stiff behaviour can be beneficial for some actions, such as running, but can create impairments for a wearer when attempting to perform other actions. FIG. 1 shows positions of a shoe 100 during a kicking motion and a running motion. In the example shown, the shoe 100 can be a typical football shoe. The shoe 100 comprises a sole structure 102. The sole structure 102 comprises a heel portion 104 and a forefoot portion 106. The sole structure 102 comprises a midfoot portion 108 between the heel portion 104 and the forefoot portion 106. When running (shown on the right side of FIG. 1), the midfoot portion 108 provides support for the foot of the wearer as the forefoot portion 106 and the heel portion 104 move away from each other during dorsiflexion of the foot of the wearer. When kicking a ball (shown on the left side of FIG. 1), the midfoot portion 108 can bend to allow the forefoot portion 106 and the heel portion 104 to move towards each other during plantarflexion of the foot of the wearer.

Increasing stiffness of the midfoot portion 108 can provide increased stability for the foot of the wearer when running. However, increasing stiffness of the midfoot portion 108 can limit plantarflexion of the foot of the wearer when kicking a ball. Limiting plantarflexion of the foot can create limitations for a wearer, such as limiting the velocity of the ball off the foot. Decreasing stiffness of the midfoot portion 108 can allow for greater plantarflexion of the foot of the wearer. However, decreasing stiffness of the midfoot portion 108 can reduce stability for the foot of the wearer when running.

Sole structures according to embodiments of the present disclosure can allow for increased plantarflexion of the foot when performing an action such as kicking a ball while maintaining stability of the sole during dorsiflexion of the wearer's foot. In particular embodiments, sole structures according to embodiments of the present disclosure can allow for increased plantarflexion of the foot when kicking a ball while maintaining stability of when running. For example, sole structures according to embodiments of the present disclosure can comprise a midfoot portion that allows for increased plantarflexion of the foot when kicking a ball while maintaining stability of the midfoot portion when running. The increased plantarflexion can increase the velocity of the ball off the foot of the wearer, thereby increasing kicking performance. The midfoot portion according to embodiments of the present disclosure can be any portion of the sole located between a heel-most portion and a forefoot-most portion of the sole. In some embodiments, the midfoot portion can be located such that it is configured to support all of a portion of a wearer's foot arch when a shoe comprising the midfoot portion is worn.

Figure 2:
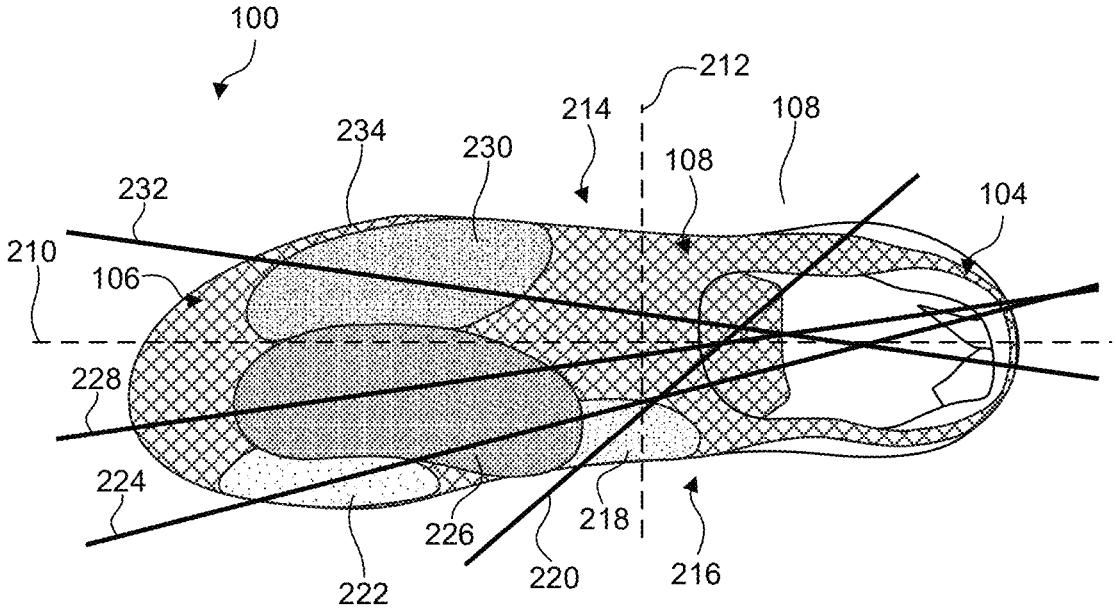
FIG. 2 shows a top view of an upper portion of a shoe.

FIG. 2 shows a top view of an upper portion 234 of the shoe 100. The shoe 100 comprises a longitudinal axis 210. The longitudinal axis 210 extends between the heel portion 104 of the shoe 100 and the forefoot portion 106 of the shoe 100. The shoe 100 comprises a transverse axis 212. The transverse axis 212 extends between a medial side 216 of the shoe 100 and a lateral side 214 of the shoe 100. The transverse axis 212 is perpendicular to the longitudinal axis 210.

Different areas of the upper portion 234 can be used to kick a ball along different axes (for example, when passing, shooting, curving the ball, etc.). For example, an instep area 218 can be used to kick the ball along an instep axis 220. A medial toe area 222 can be used to kick the ball along a medial toe axis 224. A top area 226 can be used to kick the ball along a top axis 228. A lateral toe area 230 can be used to kick the ball along a lateral toe axis 232.

Sole structures for shoes typically exhibit substantially isotropic bending behaviour about various bending axes (for example, the sole structures bend symmetrically about a bending axis). With reference to FIGS. 1-2, the midfoot portion 108 of the sole structure 102 of the shoe 100 can bend about the transverse axis 212 of the midfoot portion 108 when the wearer kicks the ball. The forces on the midfoot portion 108 can differ based on the area used to kick the ball, however the midfoot portion 108 bends in the same manner regardless of the area of the upper portion 234 used to kick the ball.

Sole structures according to embodiments of the present disclosure can exhibit anisotropic bending behaviour about various bending axes so the sole structures can bend in a desired manner based on the area of the upper portion 234 used to kick the ball. For example, sole structures according to embodiments of the present disclosure can exhibit different bending stiffnesses when bent around an axis perpendicular to longitudinal axis 210, when bent around an axis perpendicular to instep axis 220, when bent around an axis perpendicular to medial toe axis 224, when bent around an axis perpendicular to top axis 228, and/or when bent around an axis perpendicular to lateral toe axis 232. For example, in some embodiments, the sole structures can exhibit a first bending stiffness when bent around an axis perpendicular to longitudinal axis 210, a second bending stiffness when bent around an axis perpendicular to instep axis 220, a third bending stiffness when bent around an axis perpendicular to medial toe axis 224, a fourth bending stiffness when bent around an axis perpendicular to top axis 228, a fifth bending stiffness when bent around an axis perpendicular to lateral toe axis 232, or any combination thereof. In particular embodiments, midfoot portions described herein can exhibit a first bending stiffness when bent around an axis perpendicular to longitudinal axis 210, a second bending stiffness when bent around an axis perpendicular to instep axis 220, a third bending stiffness when bent around an axis perpendicular to medial toe axis 224, a fourth bending stiffness when bent around an axis perpendicular to top axis 228, a fifth bending stiffness when bent around an axis perpendicular to lateral toe axis 232, or any combination thereof.

Further, in some cases, a wearer may desire a shoe that provides increased plantarflexion of the foot when kicking a ball in on or more directions to increase the velocity of ball. The wearer may also desire a shoe that provides stability when sprinting, changing directions, etc. Sole structures of typical shoes do not provide a satisfactory solution to address both characteristics (for example, increased plantarflexion and stability). Sole structures of the present disclosure can provide both increased plantarflexion in or more directions and stability of the sole during dorsiflexion in one or more directions.

Figure 3:
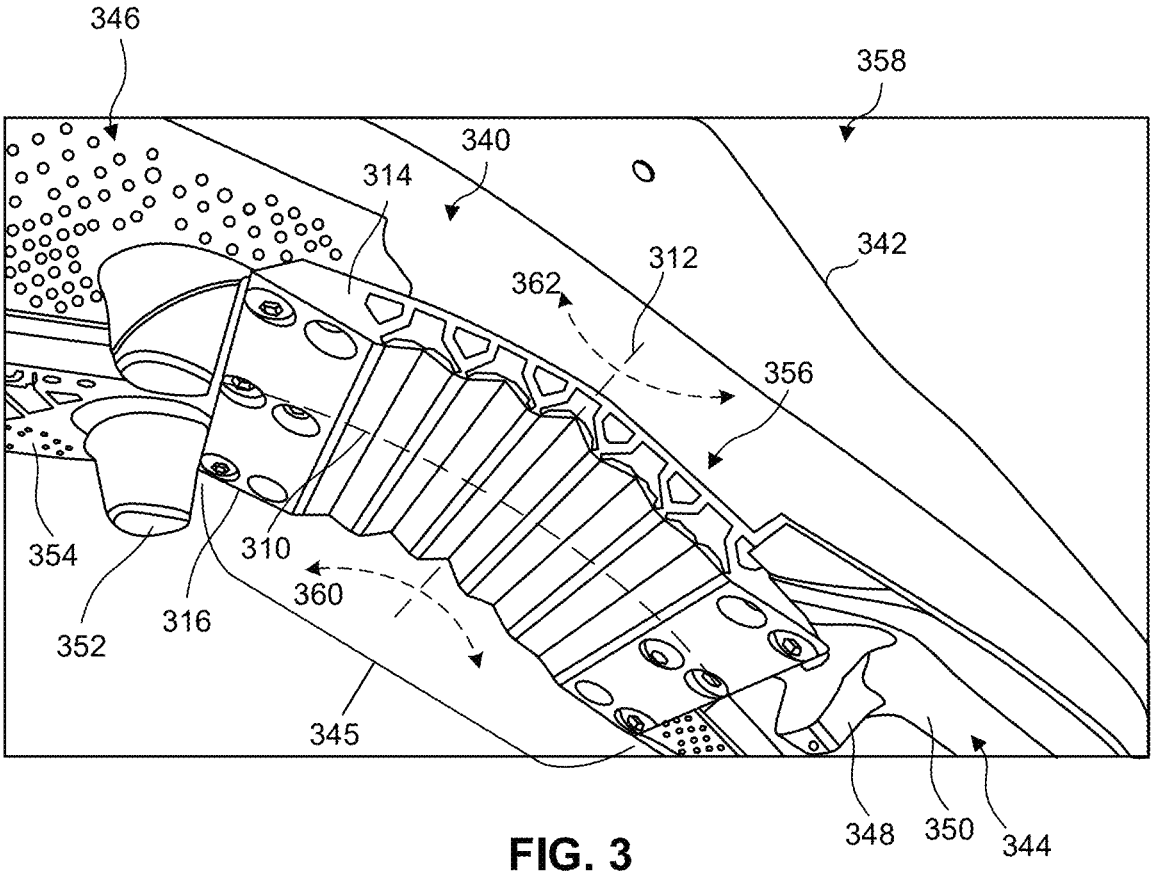
FIG. 3 shows a sole structure coupled to an upper portion according to some embodiments.

FIG. 3 shows a sole structure 340 according to some embodiments. The sole structure 340 can be coupled to an upper portion 342 of a shoe. The sole structure 340 comprises a forefoot portion 344. The forefoot portion 344 is located underneath a forefoot of a wearer (for example, the portion of the foot of the wearer that comprises the toes). The sole structure 340 comprises a heel portion 346. The heel portion 346 is located underneath a heel of the wearer. In some embodiments, the forefoot portion 344 comprises cleats 348 on a ground-facing side 350 of the forefoot portion 344. In some embodiments, the heel portion 346 comprises cleats 352 on a ground-facing side 354 of the heel portion 346.

The sole structure 340 comprises a midfoot portion 356. The midfoot portion is located underneath all or a portion of a midfoot of the wearer (for example, the portion of the foot of the wearer that comprises the arch of the foot). The midfoot portion 356 is coupled to the forefoot portion 344. The midfoot portion is coupled to the heel portion 346. In some embodiments, the midfoot portion 356 can bridge a gap 345 between the forefoot portion 344 and the heel portion 346. In some embodiments, the gap 345 can be open space located between a foremost end of heel portion 346 and a rearmost end of the forefoot portion 344.

As shown for example, in FIG. 3, the midfoot portion 356 comprises a longitudinal axis 310. The longitudinal axis 310 extends lengthwise along the midfoot portion 356 between the forefoot portion 344 and the heel portion 346. The midfoot portion 356 also comprises a transverse axis 312 disposed perpendicular to the longitudinal axis 310. The transverse axis 312 extends across a midpoint of the midfoot portion 356 between a medial side 314 of the midfoot portion 356 and a lateral side 316 of the midfoot portion 356.

In some embodiments, the midfoot portion 356 can be coupled to the forefoot portion 344 and the heel portion 346 using one or more connectors such as screws, bolts, rivets, or any other type of connector that can couple two components together. In some embodiments, the connectors can be removable such that the midfoot portion can be replaced as discussed below. In some embodiments, the midfoot portion 356 can be coupled to the forefoot portion 344 and the heel portion 346 via an overmolding process (for example, the material for the midfoot portion 356 is molded on to the forefoot portion 344 and the heel portion 346). In such embodiments, the midfoot portion 356 can be integrally formed with forefoot portion 344 and the heel portion 346 as a single piece. In some embodiments, the midfoot portion 356 can be coupled to the forefoot portion 344 and the heel portion 346 using an adhesive.

In some embodiments, the midfoot portion 356 can be formed from a polymer. More specifically, the midfoot portion 356 can be formed from polyamide, polyurethane, thermoplastic elastomer, or a combination thereof.

In some embodiments, the midfoot portion 356 can be removably coupled to the forefoot portion 344 and the heel portion 346. For example, the midfoot portion 356 can be coupled to the forefoot portion 344 and the heel portion 346 with latches, snaps, removable threaded connectors, or any other type of connector that can provide for a removable connection. The midfoot portion 356 being removable from the forefoot portion 344 and the heel portion 346 allows the wearer to exchange the midfoot portion 356 for another midfoot portion. In some embodiments, the another midfoot portion can be a new version of the midfoot portion removed. In some embodiments, the another midfoot portion can comprise different bending properties than the midfoot portion 356. For example, the midfoot portion 356 can comprise a first bending stiffness in a plantarflexion direction 360 (a bending direction in which the ground-facing side 350 and the ground-facing side 354 bend toward each other) and a second bending stiffness in a dorsiflexion direction 362 (a bending direction in which the ground-facing side 350 and the ground-facing side 354 bend away from each other).

In some embodiments, the value of the second bending stiffness in the dorsiflexion direction 362 can range from 0.8 Newton-meters per degree (N-m/degree) to 1.6 N-m/degree. In some embodiments, the value of the second bending stiffness in the dorsiflexion direction 362 can range from 0.5 N-m/degree to 2 N-m/degree.

In some embodiments, as described herein, the value of the first bending stiffness in the plantarflexion direction 360 can be less than the value of the second bending stiffness in the dorsiflexion direction 362. In some embodiments, the value of the first bending stiffness in the plantarflexion direction 360 can be less than 0.8 N-m/degree, less than 0.6 N-m/degree, less than 0.4 N-m/degree, or less than 0.2 N-m/degree. In some embodiments, the value of the first bending stiffness in the plantarflexion direction 360 can range from 0.1 N-m/degree to 0.8 N-m/degree. In some embodiments, the value of the first bending stiffness in the plantarflexion direction 360 can range from 0.1 N-m/degree to 0.4 N-m/degree.

In some embodiments, the value of the first bending stiffness in the plantarflexion direction 360 can be at least 0.1 N-m/degree less than the value of the second bending stiffness in the dorsiflexion direction 362. In some embodiments, the value of the first bending stiffness in the plantarflexion direction 360 can be at least 0.2 N-m/degree less than the value of the second bending stiffness in the dorsiflexion direction 362. In some embodiments, the value of the first bending stiffness in the plantarflexion direction 360 can be at least 0.4 N-m/degree less than the value of the second bending stiffness in the dorsiflexion direction 362. In some embodiments, the value of the first bending stiffness in the plantarflexion direction 360 can be at least 0.1 N-m/degree less than the value of the second bending stiffness in the dorsiflexion direction 362 and no more than 1 N-m/degree less than the value of the second bending stiffness in the dorsiflexion direction 362. In some embodiments, the value of the first bending stiffness in the plantarflexion direction 360 can be at least 0.1 N-m/degree less than the value of the second bending stiffness in the dorsiflexion direction 362 and no more than 1.5 N-m/degree less than the value of the second bending stiffness in the dorsiflexion direction 362.

In some embodiments, the forefoot portion 344 can comprise a forefoot bending stiffness in the dorsiflexion direction 362 that is less than the second bending stiffness of the midfoot portion 356 in the dorsiflexion direction 362. In some embodiments, the value of the forefoot bending stiffness in the dorsiflexion direction 362 can be at least 0.1 N-m/degree less than the value of the second bending stiffness of the midfoot portion 356 in the dorsiflexion direction 362.

Unless specified otherwise, a bending stiffness (for example, first bending stiffness or second bending stiffness) is measured by fixing a heel portion (for example, heel portion 346), rotating a forefoot portion (for example, forefoot portion 344) relative to the heel portion, and measuring the amount of torque (in N-m) per degree required to rotate the forefoot portion relative to the heel portion. For purposes of comparing a forefoot bending stiffness in the dorsiflexion direction 362 and the bending stiffness of the midfoot portion 356 in the dorsiflexion direction 362, the dorsiflexion stiffness of the forefoot portion is measured by fixing the heel end of the forefoot portion and rotating the forefoot end of the forefoot portion.

In some embodiments, the another midfoot portion can comprise a third bending stiffness in the plantarflexion direction 360 that is different than the first bending stiffness, the another midfoot portion can comprise a fourth bending stiffness in the dorsiflexion direction 362 that is different than the second bending stiffness, or both. Thus, the sole structure 340 can comprise a modular system in which various midfoot portions can be coupled to the forefoot portion 344 and the heel portion 346 according to the desired properties of the midfoot portion. As a non-limiting example, a wearer can exchange the midfoot portion 356 for a midfoot portion comprising any of the features of midfoot portions described with reference to FIGS. 5A-5B, 6A-6B, and 7A-7B.

In some embodiments, the third bending stiffness can be equal to values, or can be within any of the ranges, described herein for the first bending stiffness. In some embodiments, the third bending stiffness can be at least 0.1 N-m/degree less than or at least 0.1 N-m/degree greater than the first bending stiffness. Similarly, the fourth bending stiffness can be equal to values, or can be within any of the ranges, described herein for the second bending stiffness. In some embodiments, the fourth bending stiffness can be at least 0.1 N-m/degree less than or at least 0.1 N-m/degree greater than the second bending stiffness.

As shown for example in FIG. 3, the plantarflexion direction 360 and the dorsiflexion direction 362 for a sole or midfoot portion can be defined relative to a transverse axis for the midfoot portion 356 (for example, transverse axis 312). For example, the midfoot portion 356 can bend in the plantarflexion direction 360 when the ground-facing side 350 of the forefoot portion 344 and the ground-facing side 354 of the heel portion bend toward each other about a transverse axis. The midfoot portion 356 can bend in the dorsiflexion direction 362 when the ground-facing side 350 and the ground-facing side 354 bend away from each other about the transverse axis. Thus, the plantarflexion direction 360 and the dorsiflexion direction 362 can be opposite directions, in some embodiments. In some embodiments, the midfoot portion 356 can bend in the plantarflexion direction 360 and/or the dorsiflexion direction 362 about an axis other than the transverse axis 312. For example, the midfoot portion 356 can bend about a transverse axis that is offset from the transverse axis 312 in a direction along the longitudinal axis 310. In some embodiments, the transverse axis can be approximately parallel to the transverse axis 312. In some embodiments, the transverse axis can be oriented at an angle non-parallel to the transverse axis 312.

The combination of the forefoot portion 344, the heel portion 346, the midfoot portion 356, and the upper portion 342 can form a shoe 358. In some embodiments, the shoe 358 is a football shoe. In some embodiments, the shoe 358 can be a shoe for other sports such as baseball, lacrosse, American football, rugby, etc. The midfoot portion 356 is further described with reference to FIGS. 4A-4B. Various embodiments of additional midfoot portions are described with reference to FIGS. 5A-5B, 6A-6B, and 7A-7B.

Figure 4A:
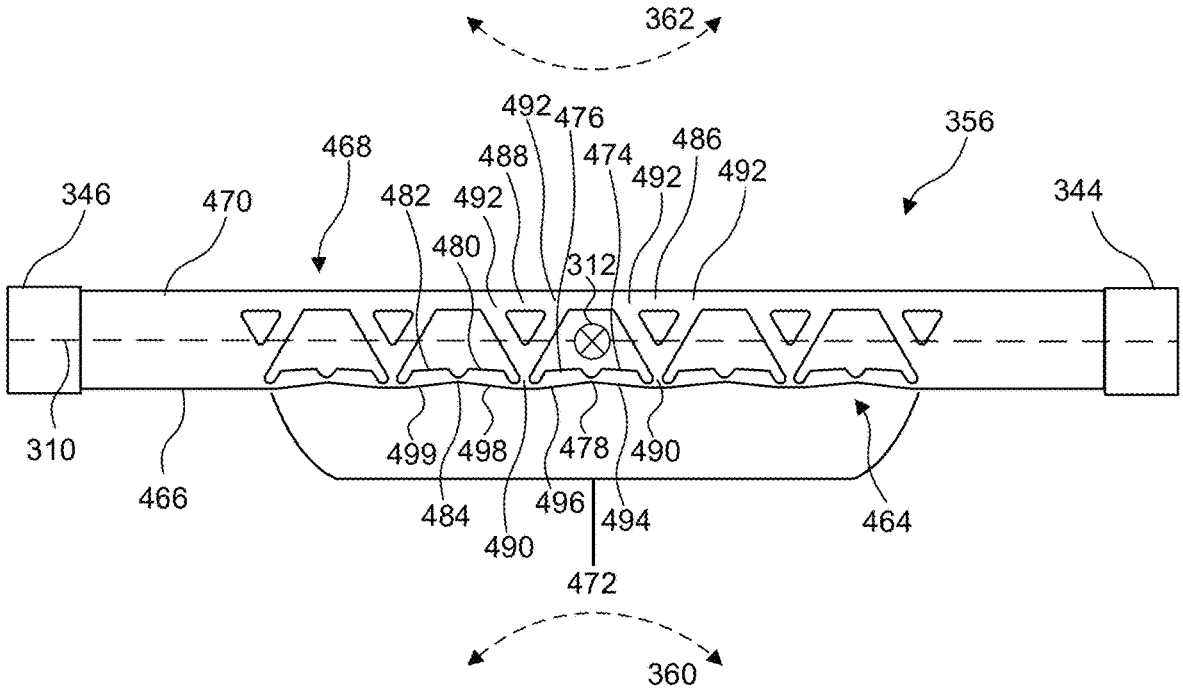
FIG. 4A shows a side view of a midfoot portion of the sole structure of FIG. 3 in a resting state, according to some embodiments.
Figure 4B:
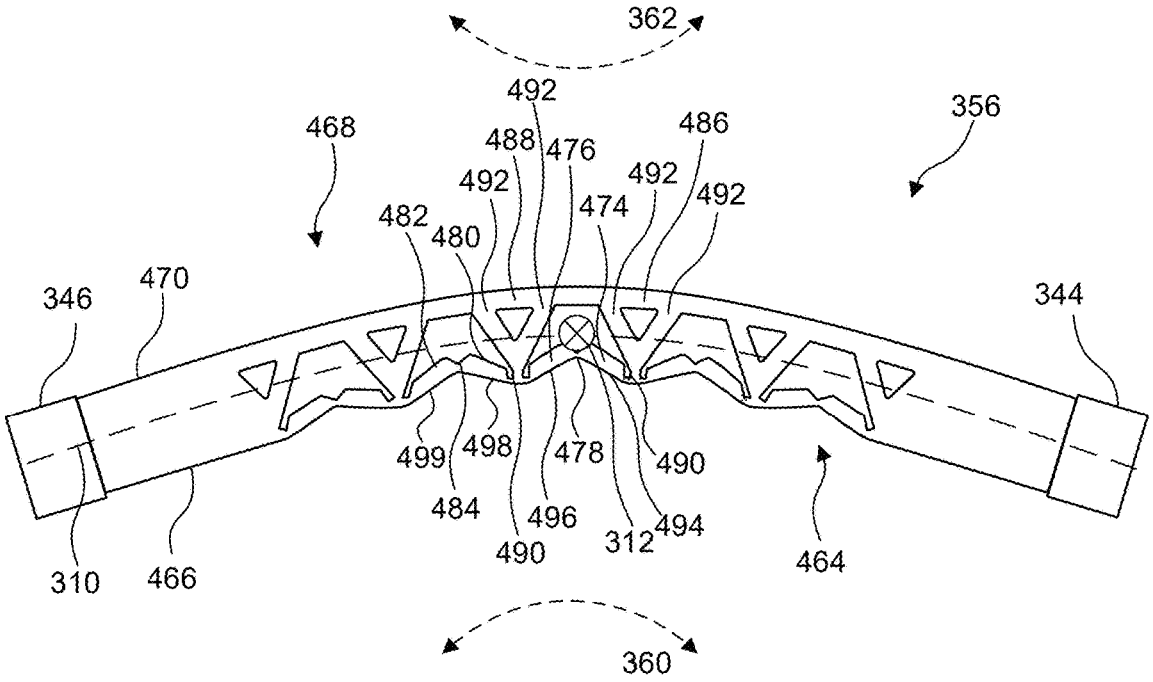
FIG. 4B shows a side view of the midfoot portion of the sole structure of FIG. 3 bending in a plantarflexion direction, according to some embodiments.

FIGS. 4A-4B show side views of the midfoot portion 356 of the sole structure 340. FIG. 4A shows a side view of the midfoot portion 356 of the sole structure 340 in a resting state. FIG. 4B shows a side view of the midfoot portion 356 of the sole structure 340 in a plantarflexion state.

The midfoot portion 356 comprises a first bending element 464. The first bending element 464 can be disposed on a ground-facing side 466 of the midfoot portion 356. The midfoot portion 356 comprises a second bending element 468. The second bending element 468 can be disposed on an upper-facing side 470 of the midfoot portion 356. The second bending element 468 can be spaced apart from the first bending element 464 in a vertical direction. As used herein, the term "vertical direction" refers to a direction that is approximately orthogonal to both the longitudinal axis 310 and the transverse axis 312.

The first bending element 464 comprises a plurality of segments 472. The plurality of segments 472 extends between the forefoot portion 344 and the heel portion 346. The plurality of segments 472 comprises a first segment 474. The plurality of segments 472 comprises a second segment 476. The first bending element 464 comprises a first hinge 478 extending between the first segment 474 and the second segment 476. The first hinge 478 allows the first segment 474 and the second segment 476 to rotate (for example, bend) relative to each other. In some embodiments, the plurality of segments 472 can comprise a third segment 480 and a fourth segment 482. In such embodiments, the first bending element 464 can comprise a second hinge 484 extending between the third segment 480 and the fourth segment 482. The second hinge 484 allows the third segment 480 and the fourth segment 482 to rotate relative to each other. In some embodiments, the plurality of segments 472 can comprise more or fewer segments than described herein. For example, the plurality of segments 472 can comprise, five, six, eight, or ten segments 472.

Any two segments 472 can be coupled by a hinge that allows the two segments 472 to rotate relative to each other. In some embodiments, two or more hinges can extend approximately parallel to each other as described herein. In some embodiments, two or more hinges can extend at an angle relative to each other as described herein.

The vertical spacing between the first bending element 464 and the second bending element 468 can be maintained by one or more connectors that extend between the first bending element 464 and the second bending element 468. For example, the midfoot portion 356 comprises a first connector 486 that couples the first bending element 464 and the second bending element 468. The first connector 486 is located between the first segment 474 and the forefoot portion 344. In some embodiments, the midfoot portion 356 comprises a second connector 488 that couples the first bending element 464 and the second bending element 468. The second connector 488 is located between the second segment 476 and the heel portion 346. In some embodiments, the midfoot portion 356 can comprise one connector located between each pair of segments. As shown, the first connector 486 and the second connector 488 comprise a triangular shape. Thus, in some embodiments the first connector 486 and the second connector 488 resemble a truss structure. In some embodiments, the first connector 486 and the second connector 488 comprise a different geometric shape (for example, square, rectangular, circular, etc.).

The first bending element 464 comprises first connection locations 490 for coupling the first connector 486 and the second connector 488 to the first bending element 464. In embodiments where more connectors are implemented, more of the first connection locations 490 can be implemented. In some embodiments, the first connection locations 490 can be at a hinge that couples two segments 472. For example, one of the first connection locations 490 can be located at a hinge between the second segment 476 and the third segment 480 that allows the second segment 476 and the third segment 480 to rotate relative to one another.

The second bending element 468 comprises second connection locations 492 for coupling the first connector 486 and the second connector 488 to the first bending element 464. As shown, a number of the first connection locations 490 can be less than a number of the second connection locations 492. In some embodiments, the number of the first connection locations 490 is one half the number of the second connection locations 492. In the embodiments shown in FIGS. 4A-4B, the first connection locations 490 are disposed at locations other than the first hinge 478. However, in some embodiments, at least one of the first connection locations 490 is disposed at the first hinge 478. In some embodiments, at least one of the first connection locations 490 is disposed at the second hinge 484. In some embodiments, each of the first connection locations 490 is disposed at a corresponding hinge. In some embodiments, adjacent first connection locations 490 can be separated by two segments 472.

As described, the midfoot portion 356 is configured to permit bending of the midfoot portion 356 in the plantarflexion direction 360. The midfoot portion 356 is configured to limit bending in the dorsiflexion direction 362. For example, when the midfoot portion 356 bends in the plantarflexion direction 360 (for example, when the wearer kicks a ball), the first segment 474 and the second segment 476 fold (for example, bend, rotate, etc.) toward each other, as shown in FIG. 4B. In some embodiments, the first segment 474 can comprise a ground-facing side 494 approximately parallel with the ground-facing side 466 when the midfoot portion 356 is in the resting state (for example, when the midfoot portion 356 is not being bent in either the plantarflexion direction 360 or the dorsiflexion direction 362). Similarly, the second segment 476 comprises a ground-facing side 496 approximately parallel with the ground-facing side 466 when the midfoot portion is in the resting state.

When the midfoot portion 356 bends in the plantarflexion direction 360, the ground-facing side 494 of first segment 474 moves toward (for example, rotates, bends, folds, etc.) the ground-facing side 496 of second segment 476. This movement is facilitated by the first hinge 478, the first connection locations 490, or both. Additionally, when the midfoot portion 356 bends in the plantarflexion direction 360, a ground-facing side 498 of the third segment 480 moves toward a ground-facing side 499 of the fourth segment 482. Similarly, this movement is facilitated by the second hinge 484, the first connection locations 490, or both. Furthermore, when the midfoot portion 356 bends in the plantarflexion direction 360, the ground-facing side 496 moves away from the ground-facing side 498. This movement is facilitated by the first connection locations 490 because the ground-facing side 496 and the ground-facing side 498 are disposed on opposite sides of one of the first connection locations 490.

When the midfoot portion 356 bends in the dorsiflexion direction 362 (for example, when the midfoot portion 356 returns to the resting state, during running, etc.), the first segment 474 and the second segment 476 fold (for example, bend, rotate, etc.) away from each other. For example, when the midfoot portion 356 bends in the dorsiflexion direction 362, the ground-facing side 494 of first segment 474 moves away from the ground-facing side 496 of second segment 476. Additionally, the ground-facing side 498 moves away from the ground-facing side 499. Furthermore, the ground-facing side 496 moves toward the ground-facing side 498.

The structure of the midfoot portion 356 can cause the midfoot portion 356 to comprise a first bending stiffness (for example, a first resistance to bending) in the plantarflexion direction 360 and a second bending stiffness (for example, a second resistance to bending) in the dorsiflexion direction 362. In some embodiments, the second bending stiffness is larger than the first bending stiffness. For example, the first bending element 464 comprises various discontinuities (for example, hinges such as the first hinge 478 and the second hinge 484, and connection locations such as the first connection locations 490) that allow the midfoot portion 356 to bend in the plantarflexion direction 360. In contrast, the second bending element 468 does not comprise such discontinuities. Additionally, the discontinuities defined by the first bending element 464 are not configured to promote bending in the dorsiflexion direction 362. Thus, bending the midfoot portion 356 in the plantarflexion direction 360 is easier than bending the midfoot portion 356 in the dorsiflexion direction 362 because the first bending stiffness is lower than the second bending stiffness. This difference in bending stiffness provides the desired functions of allowing plantarflexion when kicking a ball and providing support during running (for example, by limiting dorsiflexion).

Figure 5A:
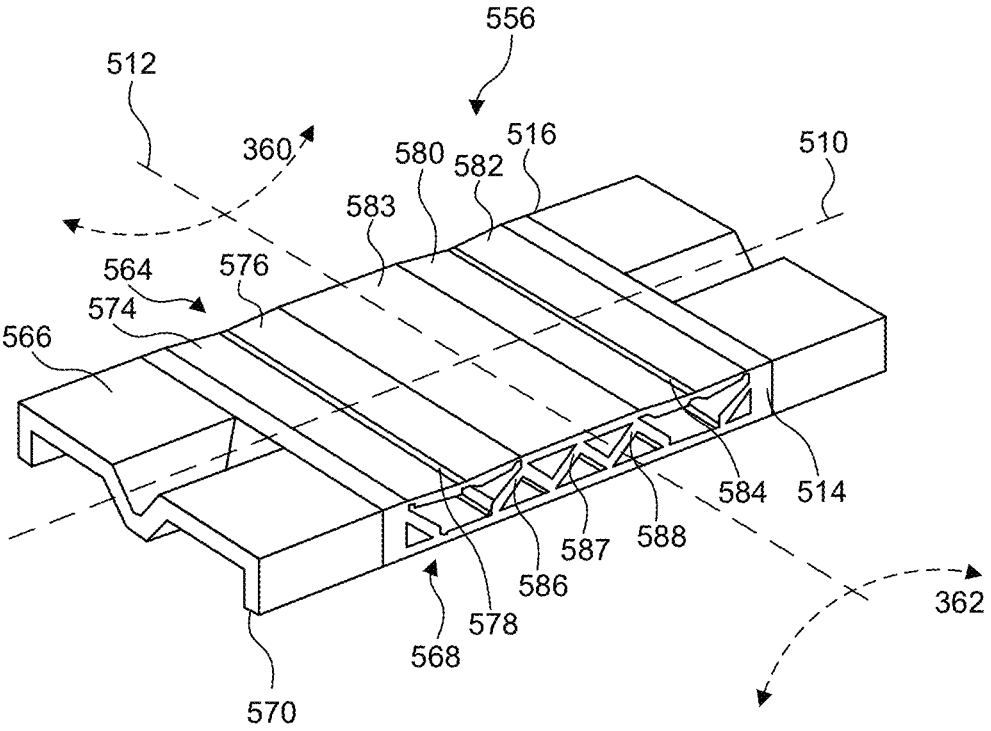
FIG. 5A shows a perspective view of a midfoot portion in a resting state, according to some embodiments.
Figure 5B:
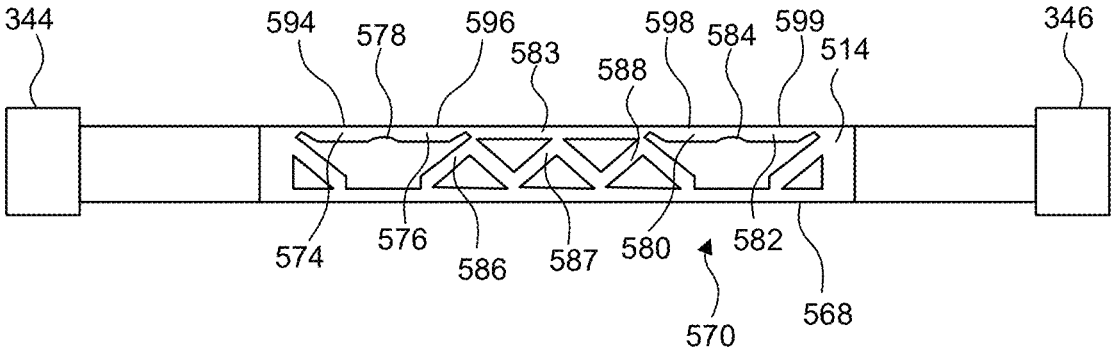
FIG. 5B shows a side view of the midfoot portion of FIG. 5A in the resting state, according to some embodiments.

Various midfoot portions with different structures can be implemented to achieve functions the same or similar to those described with respect to the midfoot portion 356. For example, FIGS. 5A and 5B show a perspective view and a side view, respectively, of a midfoot portion 556 according to some embodiments in a resting state. The midfoot portion 556 can be coupled to the forefoot portion 344 and the heel portion 346 in a manner similar to that disclosed above with respect to the midfoot portion 356. The midfoot portion 556 comprises a longitudinal axis 510 that is similar to the longitudinal axis 310. The midfoot portion 556 comprises a transverse axis 512 disposed perpendicular to the longitudinal axis 510. The transverse axis 512 is similar to the transverse axis 312.

The midfoot portion 556 comprises a first bending element 564. The first bending element 564 can be disposed on a ground-facing side 566 of the midfoot portion 556. The midfoot portion 556 comprises a second bending element 568. The second bending element 568 can be disposed on an upper-facing side 570 of the midfoot portion 556. The second bending element 568 can be spaced apart from the first bending element 564 in the vertical direction orthogonal to both the longitudinal axis 510 and the transverse axis 512. The second bending element 568 is similar to the second bending element 468.

The first bending element 564 comprises a first segment 574 and a second segment 576. In some embodiments, the first segment 574 extends approximately parallel to the second segment 576 in a direction transverse to the longitudinal axis 510 (for example, in a direction approximately parallel to the transverse axis 512). The first bending element 564 comprises a first hinge 578 extending between the first segment 574 and the second segment 576.

The first bending element 564 comprises a third segment 580 and a fourth segment 582. In some embodiments, the third segment 580 extends approximately parallel to the fourth segment 582 in a direction approximately parallel to the transverse axis 512. Thus, in some embodiments, the first segment 574, the second segment 576, the third segment 580, and the fourth segment 582 are all approximately parallel to each other. The first bending element 564 comprises a second hinge 584 extending between the third segment 580 and the fourth segment 582. In some embodiments, the first hinge 578 extends approximately parallel to the second hinge 584 in a direction approximately parallel to the transverse axis 512 (for example, a direction transverse to the longitudinal axis 510).

In some embodiments, a width, measured parallel to longitudinal axis 510, of the first segment 574 is approximately constant from a medial side 514 of the midfoot portion 556 to a lateral side 516 of the midfoot portion 556. More specifically, a width of the first segment 574 at the medial side 514 of the midfoot portion 556 is approximately equal to a width of the first segment at the lateral side 516 of the midfoot portion 556. Furthermore, widths of the second segment 576, the third segment 580, and the fourth segment 582 can be approximately constant from the medial side 514 to the lateral side 516. In some embodiments, the widths of the first segment 574, the second segment 576, the third segment 580, and the fourth segment 582 are approximately equal. In some embodiments, at least one of the first segment 574, the second segment 576, the third segment 580, and the fourth segment 582 has a width that is larger or smaller than the remaining segments.

The first bending element 564 comprises a fifth segment 583. The fifth segment 583 extends between the second segment 576 and the third segment 580. The fifth segment 583 can be coupled to the second bending element 568 with one or more connectors similar to the first connector 486 and the second connector 488. As shown, a first connector 586, a second connector 587, and a third connector 588 couple the fifth segment 583 to the second bending element 568. In some embodiments, a width of the fifth segment 583 is greater than any of the widths of the first segment 574, the second segment 576, the third segment 580, or the fourth segment 582. In some embodiments, more or fewer connectors can be implemented to support the fifth segment 583.

The fifth segment 583 can be configured to change a bending stiffness across the midfoot portion 556 such that the bending stiffness of the midfoot portion 556 is non-constant along the longitudinal axis 510. For example, when the midfoot portion 556 bends in the plantarflexion direction 360 (for example, when the wearer kicks a ball), the first segment 574 and the second segment 576 fold toward each other. More specifically, a ground-facing side 594 of the first segment 574 and a ground-facing side 596 of the second segment 576 move toward each other when the midfoot portion 556 bends in the plantarflexion direction 360. Furthermore, when the midfoot portion 556 bends in the plantarflexion direction 360, a ground-facing side 598 of the third segment 580 and a ground-facing side 599 of the fourth segment 582 move toward each other. However, because the fifth segment 583 does not comprise discontinuities (for example, hinges, etc.), the fifth segment 583 resists bending in the plantarflexion direction 360 more than the first segment 574, the second segment 576, the third segment 580, and the fourth segment 582. More specifically, the portions of the midfoot portion 556 closer to the forefoot portion 344 and the heel portion 346 can comprise a bending stiffness in the plantarflexion direction 360 that is lower than the bending stiffness of the fifth segment 583 in the plantarflexion direction 360. Thus, in the embodiment shown in FIGS. 5A-5B, a central area of the midfoot portion 556 comprises a higher bending stiffness in the plantarflexion direction 360 than portions of the midfoot portion 556 closer to the forefoot portion 344 and the heel portion 346.

In some embodiments, the location of the fifth segment 583 relative to the other segments can be altered to change the bending characteristics of the midfoot portion 556 in the plantarflexion direction 360. For example, the fifth segment 583 can be positioned closer to the forefoot portion 344, and the first segment 574 and the second segment 576 can be positioned in the central portion of the midfoot portion 556. In this example, the area of the midfoot portion 556 located closer to the forefoot portion 344 comprises a higher bending stiffness in the plantarflexion direction 360 than the central area of the midfoot portion 556 and the area of the midfoot portion 556 located closer to the heel portion 346. In another example embodiment, the fifth segment 583 can be positioned closer to the heel portion 346, and the third segment 580 and the fourth segment 582 can be positioned in the central area of the midfoot portion 556. In this example, the area of the midfoot portion 556 located closer to the heel portion 346 comprises a higher bending stiffness in the plantarflexion direction 360 than the central area of the midfoot portion 556 and the area of the midfoot portion 556 located closer to the forefoot portion 344.

Figure 6A:
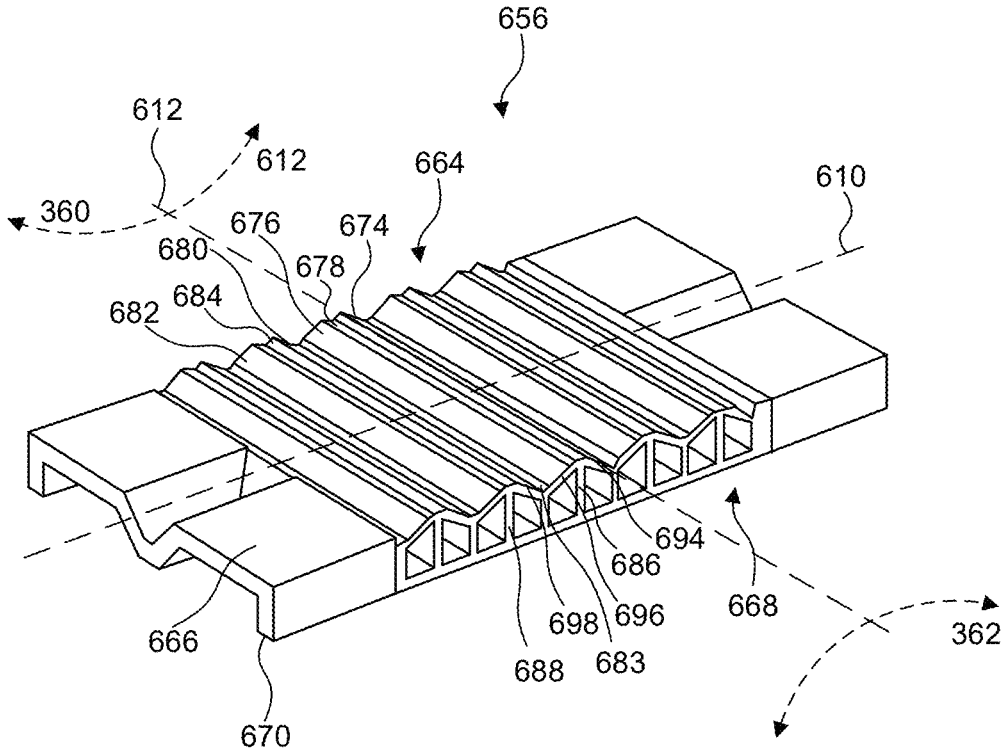
FIG. 6A shows a perspective view of a midfoot portion in a resting state, according to some embodiments.
Figure 6B:
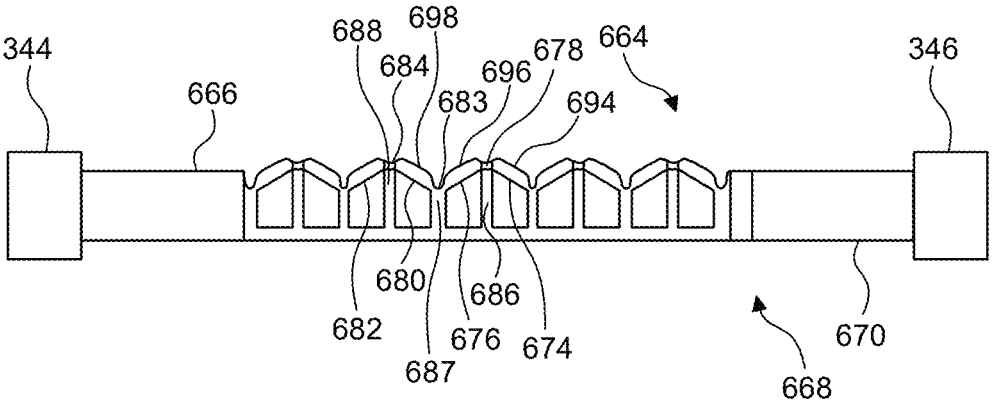
FIG. 6B shows a side view of the midfoot portion of FIG. 6A in the resting state, according to some embodiments.

FIGS. 6A and 6B show a perspective view and a side view, respectively, of a midfoot portion 656 according to some embodiments in a resting state. The midfoot portion 656 can be coupled to the forefoot portion 344 and the heel portion 346 in a manner similar to that disclosed above with respect to the midfoot portion 356. The midfoot portion 656 comprises a longitudinal axis 610 that is similar to the longitudinal axis 310 and the longitudinal axis 510. The midfoot portion 656 comprises a transverse axis 612 disposed perpendicular to the longitudinal axis 610. The transverse axis 612 is similar to the transverse axis 312 and the transverse axis 512.

The midfoot portion 656 comprises a first bending element 664. The first bending element 664 can be disposed on a ground-facing side 666 of the midfoot portion 656. The midfoot portion 656 comprises a second bending element 668. The second bending element 668 can be disposed on an upper-facing side 670 of the midfoot portion 656. The second bending element 668 can be spaced apart from the first bending element 664 in the vertical direction orthogonal to both the longitudinal axis 610 and the transverse axis 612.

The first bending element 664 comprises a first segment 674 and a second segment 676. In some embodiments, the first segment 674 extends approximately parallel to the second segment 676 in a direction transverse to the longitudinal axis 610 (for example, in a direction approximately parallel to the transverse axis 612). The first bending element 664 comprises a first hinge 678 extending between the first segment 674 and the second segment 676. The first bending element 664 also comprises a third segment 680 and a fourth segment 682. In some embodiments, the third segment 680 extends approximately parallel to the fourth segment 682 in a direction approximately parallel to the transverse axis 612.

The midfoot portion 656 comprises a first connector 686 that couples the first bending element 664 to the second bending element 668. More specifically, the first connector 686 extends between the second bending element 668 and the first hinge 678. The first connector 686 extends approximately orthogonal to the longitudinal axis 610 and the transverse axis 612. The midfoot portion 656 also comprises a second connector 687 that couples the first bending element 664 to the second bending element 668. More specifically, the second connector 687 extends between the second bending element 668 and a second hinge 683 (for example, a hinge that extends between the second segment 676 and the third segment 680). The second connector 687 can extend approximately orthogonal to the longitudinal axis 610 and the transverse axis 612. In some embodiments, the midfoot portion 656 comprises a third connector 688 that couples the first bending element 664 to the second bending element 668. More specifically, the third connector 688 extends between the second bending element 668 and a third hinge 684 (for example, a hinge that extends between the third segment 680 and the fourth segment 682). The third connector 688 can extend approximately orthogonal to the longitudinal axis 610 and the transverse axis 612.

As shown, each of the first connector 686, the second connector 687, and the third connector 688 can connect to the second bending element 668 at a single connection location. Additionally, each of the first connector 686, the second connector 687 and the third connector 688 can connect to the first bending element 664 at a single connection location. Thus, in the embodiment shown, a number of connection locations on the first bending element 664 can be equal to a number of connection locations on the second bending element 668.

When the midfoot portion 656 bends in the plantarflexion direction 360, the first segment 674 and the second segment 676 fold away from each other. For example, as the midfoot portion 656 bends in the plantarflexion direction 360, a ground-facing side 694 of first segment 674 moves away from a ground-facing side 696 of second segment 676. Similarly, as the midfoot portion 656 bends in the plantarflexion direction 360, a ground-facing side 698 of third segment 680 moves toward a ground-facing side 696 of second segment 676. The relative motions between the segments are facilitated by the first connector 686, the second connector 687, the third connector 688, and the first hinge 678, the second hinge 683, and the third hinge 684.

Figure 7A:
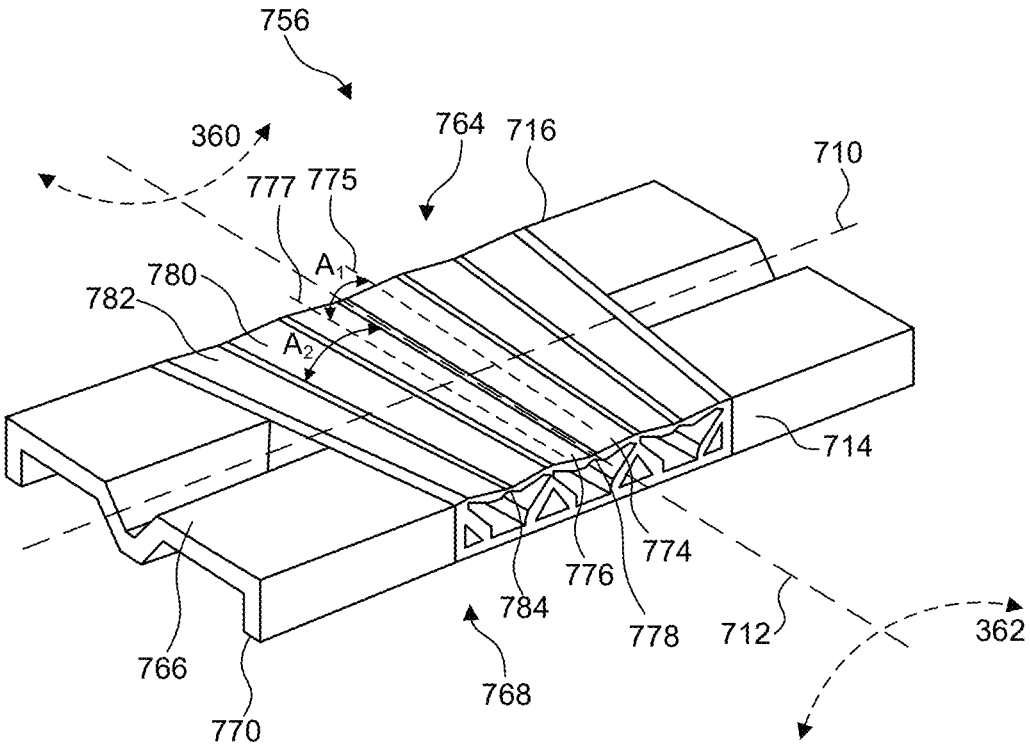
FIG. 7A shows a perspective view of a midfoot portion in a resting state, according to some embodiments.
Figure 7B:
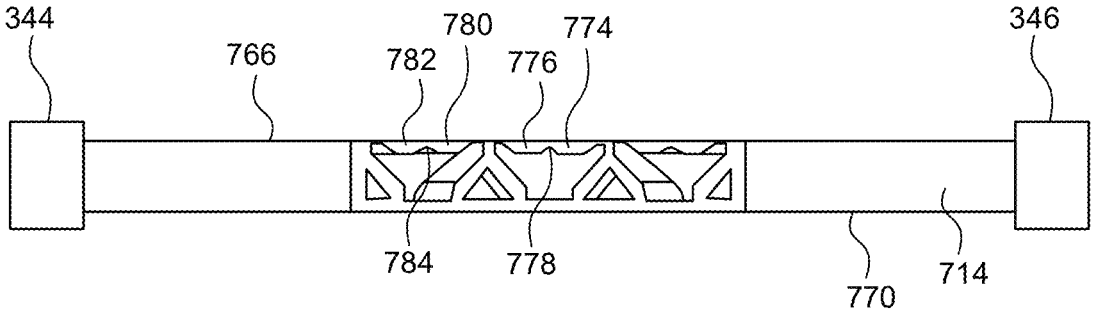
FIG. 7B shows a side view of the midfoot portion of FIG. 7A in the resting state, according to some embodiments.

In some embodiments, midfoot portion 656 can comprise more segments than described herein. For example, midfoot portion 656 can comprise, five, six, eight, or ten segments. Any two of the segments can be coupled by a hinge that allows the two segments to rotate relative to each other and a first connector can extend between the second bending element 668 and the hinge. In some embodiments, two or more hinges can extend approximately parallel to each other as described herein. In some embodiments, two or more hinges can extend at any angle relative to each other as described herein FIGS. 7A and 7B show a perspective view and a side view, respectively, of a midfoot portion 756 in a resting state. The midfoot portion 756 can be coupled to the forefoot portion 344 and the heel portion 346 in a manner similar to that disclosed above with respect to the midfoot portion 356. The midfoot portion 756 comprises a longitudinal axis 710 that is similar to the longitudinal axis 310, the longitudinal axis 510, and the longitudinal axis 610. The midfoot portion 756 comprises a transverse axis 712 disposed perpendicular to the longitudinal axis 710. The transverse axis 712 is similar to the transverse axis 312, the transverse axis 512, and the transverse axis 612.

The midfoot portion 756 comprises a first bending element 764. The first bending element 764 can be disposed on a ground-facing side 766 of the midfoot portion 756. The midfoot portion 756 comprises a second bending element 768. The second bending element 768 can be disposed on an upper-facing side 770 of the midfoot portion 756. The second bending element 768 can be spaced apart from the first bending element 764 in the vertical direction orthogonal to both the longitudinal axis 710 and the transverse axis 712.

The first bending element 764 comprises a first segment 774 and a second segment 776. In some embodiments, the first segment 774 extends at an angle $A_1$ relative to the second segment 776 in a direction transverse to the longitudinal axis 710. For example, a width of the first segment 774 (a distance across the first segment 774 in a direction parallel to the longitudinal axis 710) at a medial side 714 of the midfoot portion 756 can be smaller than the width of the first segment 774 at a lateral side 716 of the midfoot portion 756. Thus, a midline axis 775 of the first segment 774 is oriented at an angle relative to the transverse axis 712. Similarly, a width of the second segment 776 at the medial side 714 of the midfoot portion 756 can be smaller than the width of the second segment 776 at the lateral side 716 of the midfoot portion 756. Thus, a midline axis 777 of the second segment 776 is oriented at an angle relative to the transverse axis 712.

The angle $A_1$ is determined based on the location of the first segment 774 and the second segment 776 relative to the transverse axis 712. For example, if the first segment 774 and the second segment 776 are located on the same side of the transverse axis 712, the angle $A_1$ is determined by finding the difference between the angles of the midline axis 775 and the midline axis 777 relative to the transverse axis 712. If the first segment 774 and the second segment 776 are located on different sides of the transverse axis 712 (as shown in FIG. 7A), the angle $A_1$ is determined by finding the sum of the angles of the midline axis 775 and the midline axis 777 relative to the transverse axis 712. In some embodiments, the angle $A_1$ is greater than or equal to 5 degrees. In some embodiments, the angle $A_1$ is less than or equal to 45 degrees.

The first bending element 764 comprises a first hinge 778 extending between the first segment 774 and the second segment 776. In some embodiments, the first bending element 764 comprises a third segment 780 and a fourth segment 782. In such embodiments, the first bending element 764 comprises a second hinge 784 extending between the third segment 780 and the fourth segment 782. In some embodiments, the first hinge 778 extends at an angle $A_2$ relative to the second hinge 784 in a direction transverse to the longitudinal axis 710 of the midfoot portion 756. For example, a longitudinal distance between the first hinge 778 and the second hinge 784 (a distance between the first hinge 778 and the second hinge 784 in a direction parallel to the longitudinal axis 710) at the medial side 714 of the midfoot portion 756 can be greater than a longitudinal distance between the first hinge 778 and the second hinge 784 at the lateral side 716 of the midfoot portion 756.

In some embodiments, the relative distances at the medial side 714 and the lateral side 716 of the midfoot portion 756 can be reversed. For example, the longitudinal distance between the first hinge 778 and the second hinge 784 at the medial side 714 of the midfoot portion 756 can be less than the longitudinal distance between the first hinge 778 and the second hinge 784 at the lateral side 716 of the midfoot portion 756.

In some embodiments the angle $A_2$ is greater than or equal to 5 degrees. In some embodiments, the angle $A_2$ is less than or equal to 45 degrees.

In some embodiments, midfoot portion 756 can comprise more segments than described herein. For example, midfoot portion 756 can comprise, five, six, eight, or ten segments.

The arrangements of the segments (for example, the first segment 774, the second segment 776, the third segment 780, and any additional segments) permit bending of the midfoot portion 756 in an asymmetric manner when bent in a plantarflexion direction. Based on the relative lengths of the segments at the medial side 714 and the lateral side 716, the midfoot portion 756 can bend more toward the medial side 714 or the lateral side 716. This can provide the wearer the ability to select a midfoot portion 756 that provides the type of plantarflexion desired. For example, the wearer can select the midfoot portion 756 with the segments arranged in a way that maximizes plantarflexion to support the specific type of kick.

For example, and with reference to FIG. 2, the wearer may want to maximize plantarflexion when kicking a ball using the lateral toe area 230. The wearer can select the midfoot portion 756 that allows for more plantarflexion on the lateral side 716. More specifically, the wearer can select the midfoot portion 756 in which the lengths of the segments at the medial side 714 are longer than the lengths of the segments on the lateral side 716. As another example, the wearer may want to maximize plantarflexion when kicking a ball using the instep area 218. The wearer can select the midfoot portion 756 that allows for more plantarflexion on the medial side 714. More specifically, the wearer can select the midfoot portion 756 in which the lengths of the segments at the lateral side 716 are longer than the lengths of the segments at the medial side 714.

Features described herein with respect to specific embodiments are not intended to be related only to the embodiments with which they are described. Features can be implemented in different embodiments where practicable. For example, one or more segments of any of the embodiments described herein can comprise a width that is greater than the widths of other segments in the midfoot portion. Adjusting the relative widths of the segments of the midfoot portion can alter the bending characteristics of the midfoot portion based on the preferences of the wearer. Additionally, any of the connectors described herein (for example, the first connector 486, the second connector 488, the first connector 686, the second connector 687, the third connector 688) can be implemented with any of the embodiments described herein. Furthermore, one or more segments and/or hinges can comprise an angle relative to another segment and/or hinge. Adjusting the relative angles between the segments and/or the hinges can alter the bending symmetry of the midfoot portion based on preferences of the wearer. Any of the midfoot segments described herein can be modular such that any of the midfoot portions can be replaced with another midfoot portion having different properties as desired by the wearer.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. A sole structure for a shoe, the sole structure comprising:

a forefoot portion;

a heel portion; and a midfoot portion coupled to the forefoot portion and the heel portion, the midfoot portion configured to bend in a plantarflexion direction and a dorsiflexion direction, the midfoot portion comprising:

a first bending element disposed at a ground-facing side of the midfoot portion, the first bending element comprising a plurality of segments extending between the forefoot portion and the heel portion, the plurality of segments comprising a first segment and a second segment, the first bending element further comprising a first hinge extending between the first segment and the second segment, and a second bending element disposed at an upper-facing side of the midfoot portion, the second bending element vertically spaced apart from the first bending element, wherein, when the midfoot portion bends in the plantarflexion direction, a ground-facing side of the first segment moves toward a ground-facing side of the second segment, and when the midfoot portion bends in the dorsiflexion direction, the ground-facing side of the first segment moves away from the ground-facing side of the second segment.

2. The sole structure of claim 1, further comprising:

a first connector coupling the first bending element and the second bending element, the first connector located between the first segment and the forefoot portion, and a second connector coupling the first bending element and the second bending element, the second connector located between the second segment and the heel portion.

3. The sole structure of claim 2, wherein the first bending element comprises first connection locations for coupling the first connector and the second connector to the first bending element, and the second bending element comprises second connection locations for coupling the first connector and the second connector to the first bending element.

4. The sole structure of claim 3, wherein a number of the first connection locations is less than a number of the second connection locations.

5. The sole structure of claim 3, wherein at least one of the first connection locations is disposed at the first hinge.

6. The sole structure of claim 1, wherein the midfoot portion comprises a first bending stiffness in the plantarflexion direction and a second bending stiffness in the dorsiflexion direction wherein the second bending stiffness is greater than the first bending stiffness.

7. The sole structure of claim 1, wherein, when the midfoot portion bends in the plantarflexion direction, the first segment and the second segment fold toward each other, and when the midfoot portion bends in the dorsiflexion direction, the first segment and the second segment fold away from each other.

8. The sole structure of claim 1, wherein the midfoot portion comprises a polymer material.

9. The sole structure of claim 1, wherein the plurality of segments further comprises a third segment and a fourth segment, and the first bending element further comprises a second hinge extending between the third segment and the fourth segment.

10. The sole structure of claim 9, wherein the first hinge extends approximately parallel to the second hinge in a direction transverse to a longitudinal axis of the midfoot portion.

11. The sole structure of claim 9, wherein a longitudinal distance between the first hinge and the second hinge at a first side of the midfoot portion is greater than a longitudinal distance between the first hinge and the second hinge at a second side of the midfoot portion.

12. The sole structure of claim 11, wherein the first hinge extends at an angle relative to the second hinge in a direction transverse to a longitudinal axis of the midfoot portion, and wherein the angle between the first hinge and the second hinge is greater than or equal to 5 degrees and less than or equal to 45 degrees.

13. The sole structure of claim 1, wherein the first segment extends approximately parallel to the second segment in a direction transverse to a longitudinal axis of the midfoot portion.

14. The sole structure of claim 1, wherein the first segment extends at an angle relative to the second segment in a direction transverse to a longitudinal axis of the midfoot portion, and wherein the angle between the first segment and the second segment is greater than or equal to 5 degrees and less than or equal to 45 degrees.

15. The sole structure of claim 1, wherein the midfoot portion bridges a gap between the forefoot portion and the heel portion.

16. A shoe comprising the sole structure of claim 1.

17. The shoe of claim 16, wherein each of the forefoot portion and the heel portion comprise cleats.

* * * * *